US007654019B2

(12) United States Patent
Yeager et al.

(10) Patent No.: US 7,654,019 B2
(45) Date of Patent: Feb. 2, 2010

(54) QUICK COUPLING MECHANISM FOR TOOL ATTACHMENT

(75) Inventors: Murray Yeager, Regina (CA); Jaime Tratch, Regina (CA); Darryl Krochak, Edmonton (CA); Nick Kohlman, Edmonton (CA); Peter Germs, Edmonton (CA)

(73) Assignee: Brandt Industries Ltd., Regina, Saskatchewan (CA)

( * ) Notice: Subject to any disclaimer, the term of this patent is extended or adjusted under 35 U.S.C. 154(b) by 0 days.

(21) Appl. No.: 12/128,998

(22) Filed: May 29, 2008

(65) Prior Publication Data

US 2008/0296031 A1 Dec. 4, 2008

(30) Foreign Application Priority Data

May 30, 2007 (CA) ..... 2590464

(51) Int. Cl.
*E02F 3/96* (2006.01)

(52) U.S. Cl. ..... 37/468; 414/723; 403/325

(58) Field of Classification Search ..... 37/468, 37/413, 443, 444; 172/272–275; 414/723; 403/321, 322.1, 325
See application file for complete search history.

(56) References Cited

U.S. PATENT DOCUMENTS

| | | | | |
|---|---|---|---|---|
| 4,214,840 | A * | 7/1980 | Beales | 403/31 |
| 4,944,628 | A * | 7/1990 | Hulden | 403/24 |
| 5,024,010 | A * | 6/1991 | Hulden | 37/417 |
| 5,147,173 | A * | 9/1992 | Fauber et al. | 414/723 |
| 5,467,542 | A * | 11/1995 | Hulden | 37/468 |
| 5,597,283 | A * | 1/1997 | Jones | 414/723 |
| 5,890,871 | A * | 4/1999 | Woerman | 414/723 |
| 5,915,837 | A * | 6/1999 | Brown et al. | 37/468 |
| 6,123,501 | A * | 9/2000 | Pisco | 414/723 |
| 6,231,296 | B1 * | 5/2001 | Blomgren | 414/723 |
| 6,254,331 | B1 * | 7/2001 | Pisco et al. | 414/723 |
| RE37,339 | E * | 8/2001 | Horton | 37/468 |
| 6,305,106 | B1 * | 10/2001 | McLellan | 37/468 |
| 6,336,785 | B1 * | 1/2002 | Kunzman | 414/723 |
| 6,379,075 | B1 * | 4/2002 | Shamblin et al. | 403/322.1 |
| 6,487,800 | B1 * | 12/2002 | Evans et al. | 37/468 |
| 2006/0037220 | A1 * | 2/2006 | Cunningham et al. | 37/468 |
| 2006/0254096 | A1 * | 11/2006 | Poire | 37/468 |

FOREIGN PATENT DOCUMENTS

| | | |
|---|---|---|
| EP | 1 138 833 | 10/2008 |
| WO | WO 98/46835 | 10/1998 |

* cited by examiner

*Primary Examiner*—Thomas A Beach
*Assistant Examiner*—Matthew R Buck
(74) *Attorney, Agent, or Firm*—Frost Brown Todd LLC

(57) ABSTRACT

A quick coupling apparatus for coupling a tool to a tool arm comprises a coupler member attached to the tool arm, and configured to engage a mounting bracket extending out from the tool. A wedge is mounted on the coupler member and is movable, when the coupler member and mounting bracket are engaged, from a closed position engaged in a groove on the mounting bracket to an open position where the wedge is removed from the groove. A wedge positioning mechanism selectively moves the wedge to the closed position and the open position. When the wedge moves into the groove and into the closed position, a remotely operated latch control moves a safety latch from an unlatched position to a latched position to prevent the wedge from moving toward the open position. The wedge positioning mechanism can be configured to utilize a single or double acting actuator.

8 Claims, 21 Drawing Sheets

QUICK COUPLING MECHANISM FOR TOOL ATTACHMENT

This invention is in the field of machines such as hoe excavators and in particular a mechanism for coupling and uncoupling a tool to such machines, for example for coupling an excavator bucket to an excavator hoe arm.

BACKGROUND

In many types of machines different tools are coupled to and then uncoupled from the machine to accomplish different tasks. For example, a hoe excavator with a hoe arm may have a variety of buckets of various widths and shapes that are suitable for particular different tasks. Depending on the task, the desired bucket is coupled to the end of the hoe arm of the excavator, and when that task is finished the bucket will be uncoupled and a different bucket will be coupled to the arm to accomplish the next task. In addition to various buckets, other tools such as pneumatic hammers, post hole augers, and the like are often attached to the excavator arm to increase the variety of tasks that the machine may accomplish.

Changing the bucket can be time consuming and so various quick coupling mechanisms have been developed to reduce the time and effort required to couple various tools to the excavator arm. Often these tools are maneuvered in holes or like confined areas where people are working, and so it is necessary for such quick coupling mechanisms to secure the tool such that the tool cannot fall off accidentally, and further must secure the tool tightly to the end of the excavator arm such that undesirable loose movement of the tool with respect to the excavator arm is prevented and control is maintained.

U.S. Pat. No. 6,487,800 to Evans et al. discloses a quick coupler with a coupling bar that is moved by rotating threaded bolts to a closed and coupled position to secure the engagement of the end of an excavator arm to a tool, such as a bucket. U.S. Pat. No. 6,123,501 to Pisco and U.S. Pat. No. 4,214,840 to Beales also disclose quick coupler mechanisms.

Weldco-Beales Mfg. of Edmonton, Alberta, Canada uses a double acting hydraulic cylinder to move a wedge shaped coupling bar between open and closed positions. The operator must also leave the operator position and manually install a safety pin in order to ensure that the wedge is maintained in the closed position.

SUMMARY OF THE INVENTION

It is an object of the present invention to provide a quick coupling apparatus for coupling a tool to a machine that overcomes problems in the prior art.

In a first embodiment the present invention provides a quick coupling apparatus for coupling a tool to a tool arm of a tool manipulating machine. The apparatus comprises a coupler member adapted to be attached to the tool arm, and configured to engage a mounting bracket extending out from the tool. A wedge is mounted on the coupler member and is movable, when the coupler member and mounting bracket are engaged, from a closed position where the wedge is engaged in a groove on the mounting bracket and where a tapered side of the wedge bears against a corresponding tapered side of the groove to draw the coupler member into engagement with the mounting bracket, to an open position where the wedge is removed from the groove. A wedge positioning mechanism is operative to selectively move the wedge to the closed position and the open position. A safety latch is configured such that when the wedge moves into the groove and reaches the closed position, the safety latch can be moved from an unlatched position to a latched position to prevent the wedge from moving toward the open position, and a remotely operated latch control is operative to move the safety latch between the unlatched position and the latched position.

In a second embodiment the present invention provides a hoe excavator apparatus comprising a hoe arm and a coupler member attached by a first pin through an end of the hoe arm. A hydraulic cylinder is pivotally attached at one end to the hoe arm and at an opposite end to the coupler member by a second pin parallel to the first pin. A tool has a mounting bracket extending from the tool and defining a groove. A first lug on the coupler member is configured to engage with a first recess on the mounting bracket, and a second lug on the coupler member is configured to engage a second recess on the mounting bracket. The coupler and mounting brackets are configured such that when the first and second lugs are engaged with the corresponding first and second recesses the tool is properly oriented with respect to the hoe arm. A wedge is mounted on the coupler member and is movable, when the coupler member and mounting bracket are engaged, from a closed position where the wedge is engaged in the groove on the mounting bracket and where a tapered side of the wedge bears against a corresponding tapered side of the groove to draw the first and second lugs into engagement with the corresponding first and second recesses, to an open position where the wedge is removed from the groove. A wedge bias element is operative to continuously exert a wedge bias force on the wedge towards the closed position and into the groove, and is operative to exert a wedge bias force on the wedge when the wedge is in the closed position such that the wedge bias force maintains the wedge in the closed position. A single acting actuator is operative to selectively exert an actuator force on the wedge only in a direction substantially opposite to the wedge bias force to move the wedge toward the open position, and a safety latch is configured such that when the wedge moves into the groove and reaches the closed position, the safety latch moves to a latched position and prevents the wedge from moving toward the open position.

In a third embodiment the present invention provides a method of coupling a tool to a tool arm of a tool manipulating machine. The method comprises attaching a coupler member to the tool arm, and providing a mounting bracket extending out from the tool; providing a wedge movably mounted on the coupler member such that the wedge can move from an open position to a closed position; providing a wedge positioning mechanism operative to selectively move the wedge between the closed position and the open position; with the wedge in the open position, manipulating the coupler member into engagement with the mounting bracket, and operating the wedge positioning mechanism to the wedge from the open position to the closed position, wherein the wedge engages in a groove on the mounting bracket and a tapered side of the wedge bears against a corresponding tapered side of the groove to draw the coupler member into engagement with the mounting bracket as the wedge moves toward the closed position; providing a safety latch configured such that when the wedge moves into the groove and reaches the closed position, the safety latch can move to a latched position and prevent the wedge from moving toward the open position; with a remote control, moving the safety latch to the latched position; when it is desired to release the tool from the tool arm, with the remote control, moving the safety latch to an unlatched position; operating the wedge positioning mechanism to move the wedge to the open position.

In a typical embodiment of the coupler apparatus of the present invention, the actuator will be provided by a hydraulic cylinder. In one embodiment the actuator is a double acting hydraulic cylinder operative to move the wedge between the open and closed position. A solenoid or like remote control is used to move the safety latch between the latched and unlatched positions.

In another embodiment a bias element continuously forces the wedge towards the closed position, and a single acting hydraulic cylinder is only activated to move the wedge to the open position against the bias force to disengage the tool from the tool arm, and is not required to maintain the tool in engagement with the tool arm. Thus failure of the hydraulic cylinder, hydraulic hoses, or like system components will not result in the disengagement of the tool from the tool arm.

The present invention thus provides a quick coupling apparatus comprising a coupler member that is attached to the tool arm of a tool manipulating machine. For example for a boom excavator the coupler member is attached by a first pin through the end of the hoe arm, and then by a second parallel pin to the end of the hydraulic cylinder that extends and retracts to pivot the bucket about the end of the hoe arm. The first lug on the coupler member is manipulated into engagement with the first recess on the mounting bracket, and then the hydraulic cylinder is operated to pivot the coupler member about the pivot axis created by the first lug engaging the first recess such that the second lug on the coupler engages the second recess on the mounting bracket. The wedge and groove are configured such that as the wedge moves into the groove the tapered side of the wedge bears against a corresponding tapered side of the groove. The wedge is forced into the groove and the force of the tapered wedge bearing against the correspondingly tapered groove draws the second lug into the second recess to substantially rigidly connect the coupler member and the mounting bracket.

A remotely operated safety latch is provided so that when the wedge has moved to the fully engaged closed position with respect to the groove, a latch member can be moved to a latched position and engage a catch member to prevent the wedge from moving out of the groove. The operator can move the latch without leaving the operator station. In one embodiment, a latch bias element is operative to exert a latch bias force on the latch member toward the latched position so that the latch automatically moves to the latched position when the wedge reaches the closed position. An indicator can be provided to indicate to the operator that the latch is in the latched position and the coupler is safely locked to the mounting bracket. The latch prevents the wedge from moving out of the closed position in case the springs fail.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
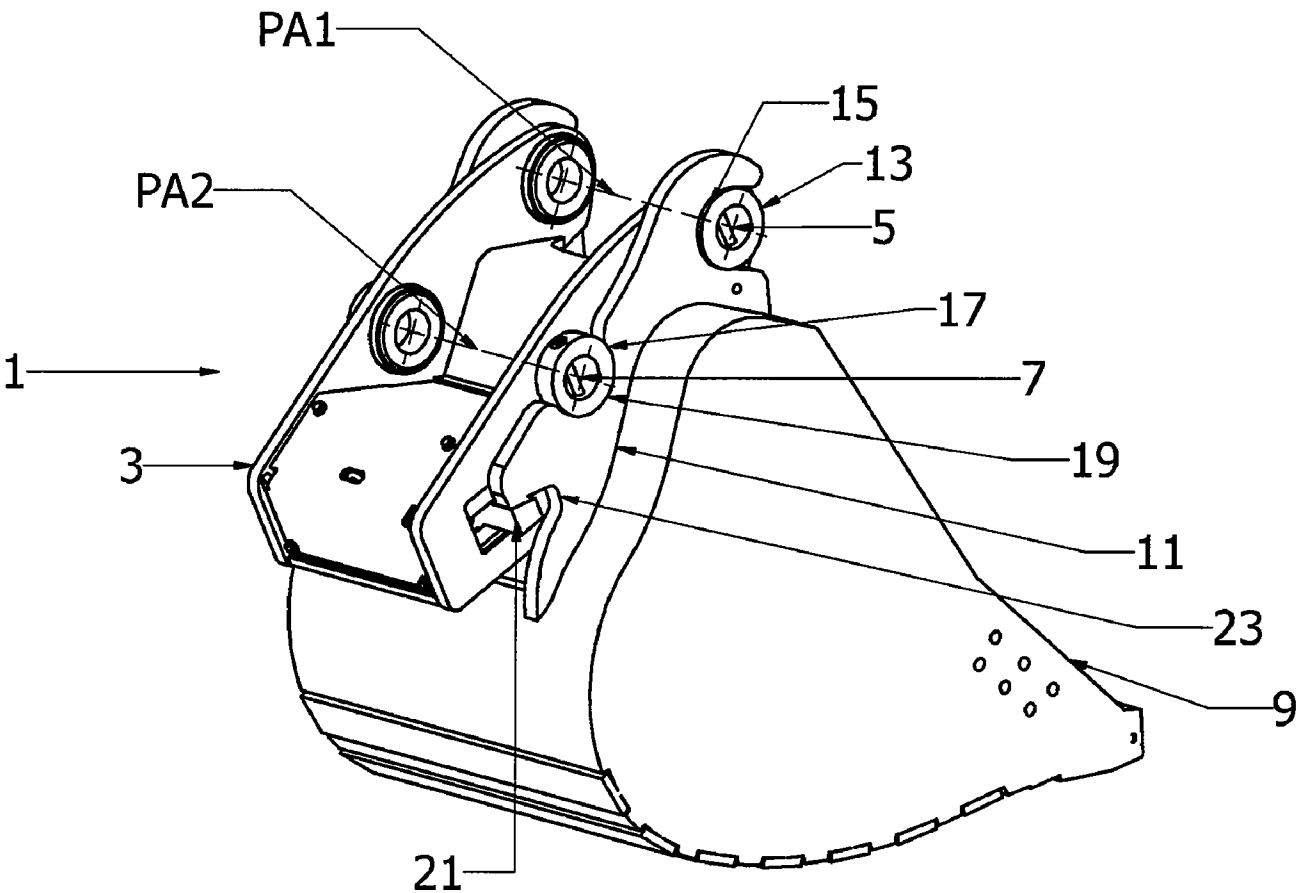
FIG. 1 is a perspective view of an embodiment of the quick coupling apparatus of the present invention connected to an excavator bucket.

FIGS. 1-5 illustrate the operation of an embodiment of a quick coupling apparatus 1 of the present invention. The apparatus 1 comprises a coupler member 3 that is attached to a tool manipulating machine at the tool attachment point. The illustrated apparatus 1 is adapted for attachment to the end of the hoe arm of an excavator. The attachment is conventional, and the hoe arm is not illustrated. The coupler member 3 is attached by a first pin through first pin aperture 5 and through a corresponding aperture on the end of the hoe arm 6, and then by a second parallel pin through second pin aperture 7 and through a corresponding aperture on the end of the hydraulic tool cylinder 8 that extends and retracts to pivot the apparatus 1 about the end of the hoe arm.

Figure 2:
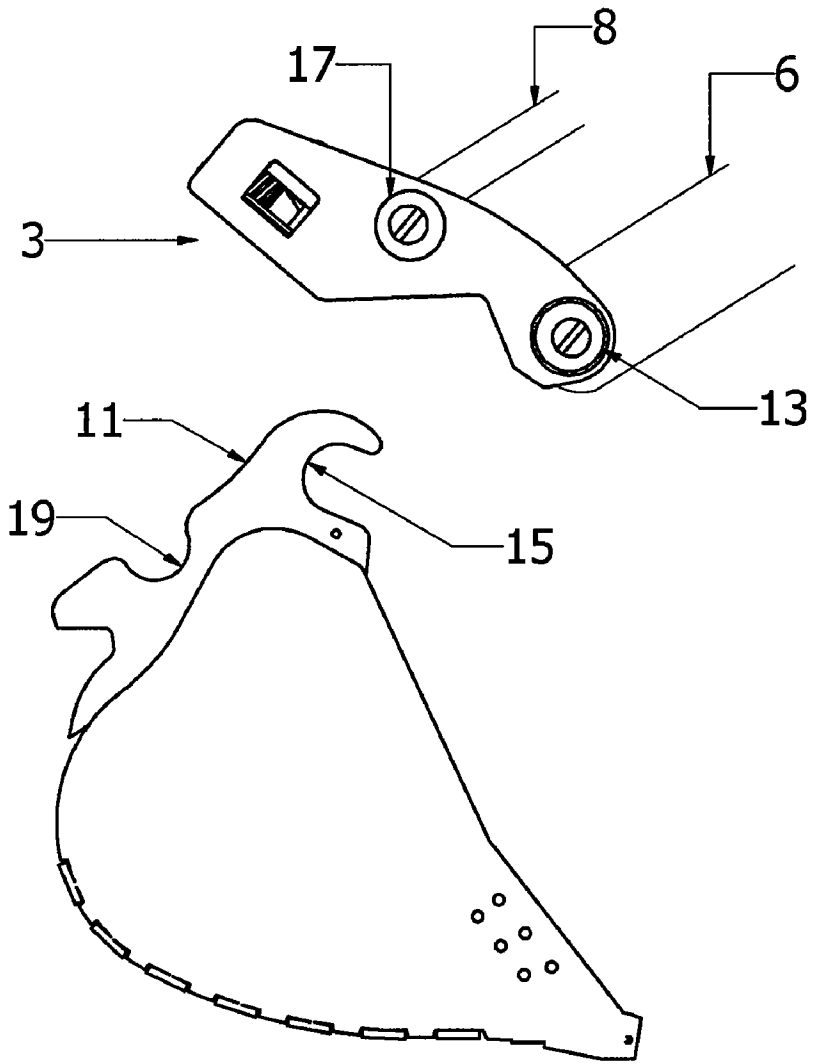
FIGS. 2-5 are side views showing the steps for installing the apparatus of FIG. 1 to the bucket.
Figure 3:
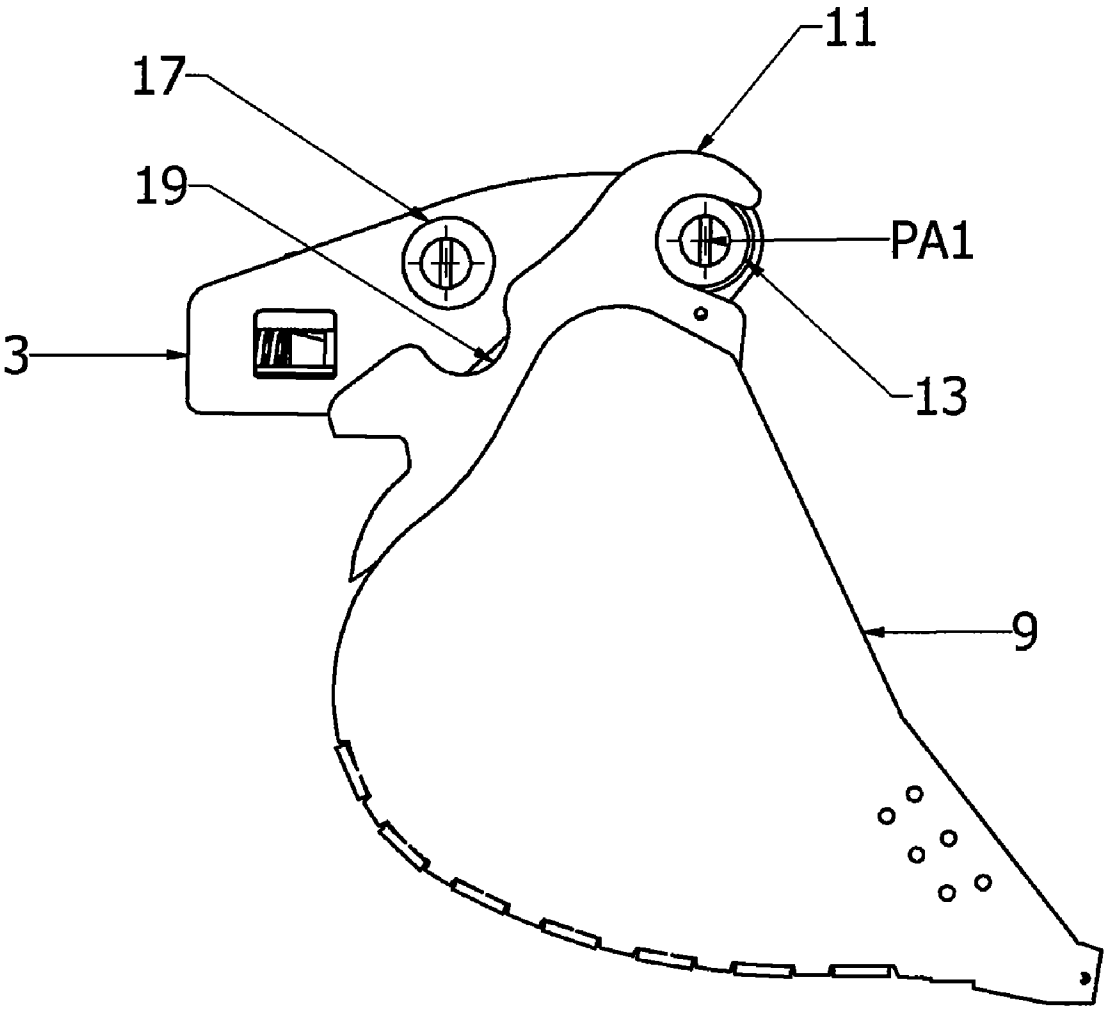
Figure 4:
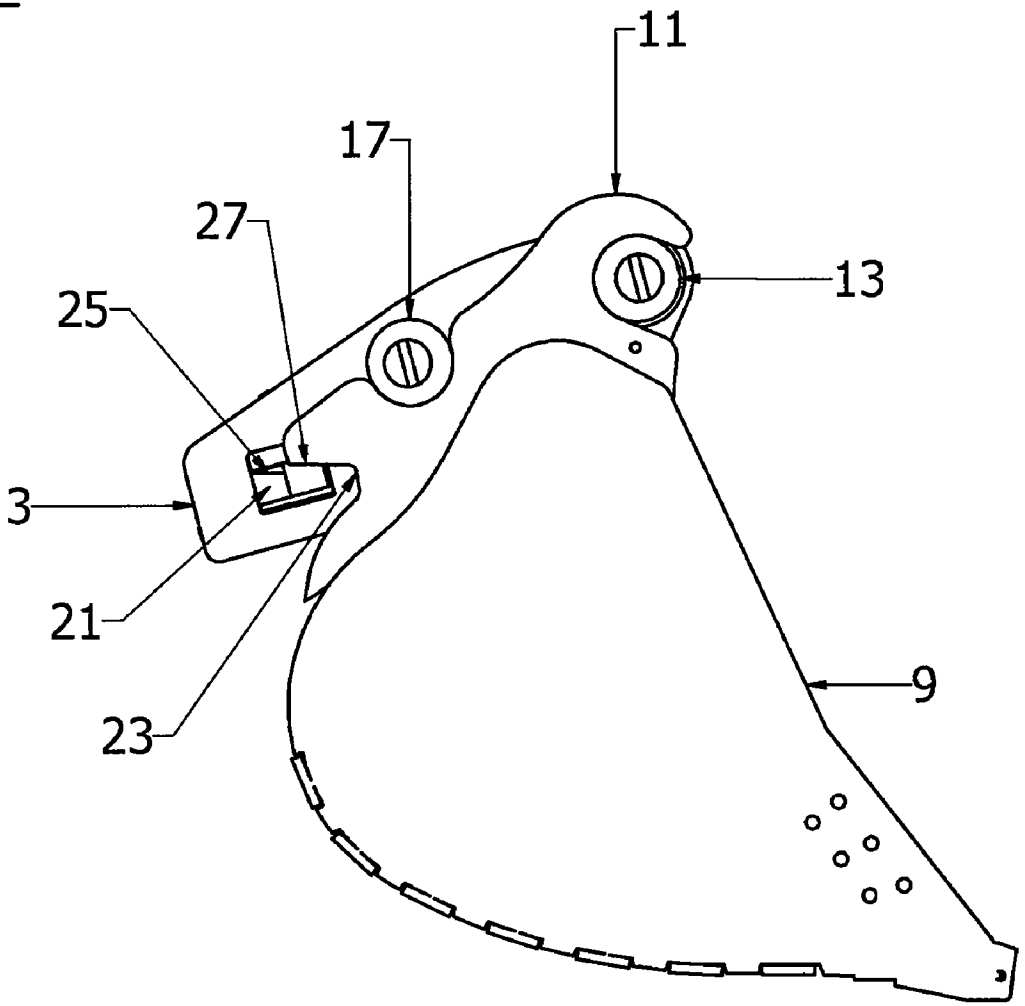

The coupler member 3 is configured to engage mounting brackets 11 that extend out from the bucket 9. A first set of lugs 13 on the coupler member 3 are manipulated from the unattached position of FIG. 2 into engagement with a corresponding first set of recesses 15 on the mounting brackets 11 as illustrated in FIG. 3, and then the hydraulic tool cylinder is operated to pivot the coupler member 3 about the pivot axis PA1 created by the first lugs 13 engaging the first recesses 15 such that a second set of lugs 17 on the coupler 3 engage a second set of recesses 19 on the mounting bracket 3 as illustrated in FIG. 4.

Figure 5:
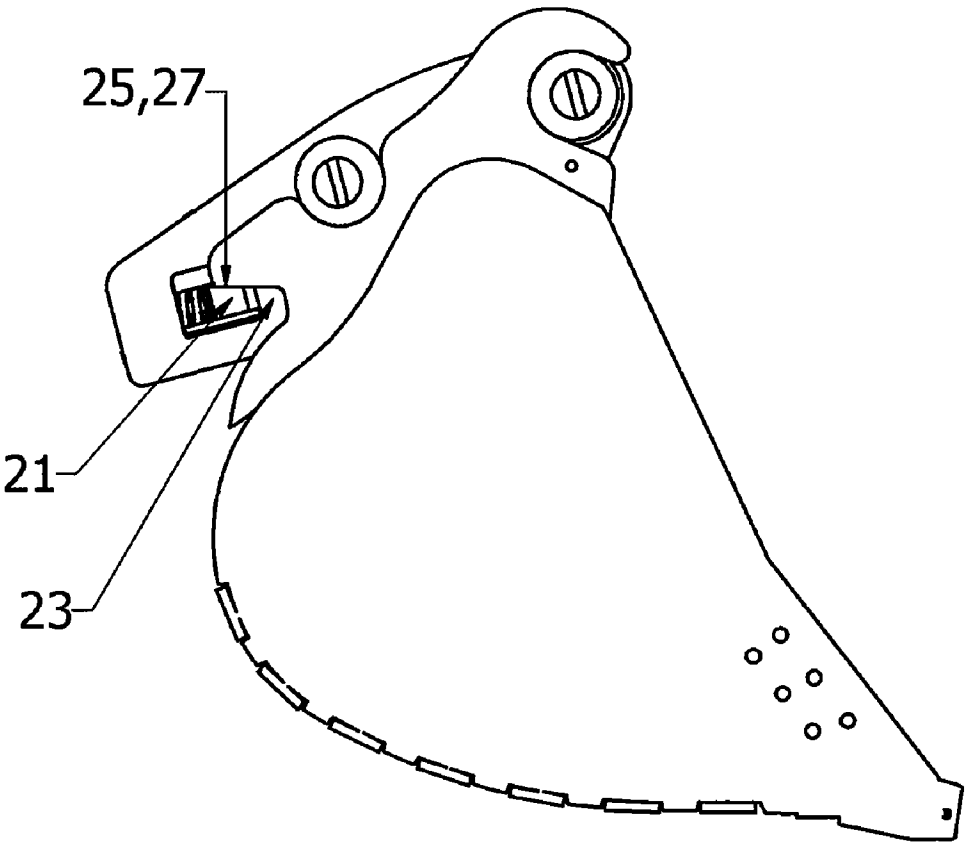
Figure 6:
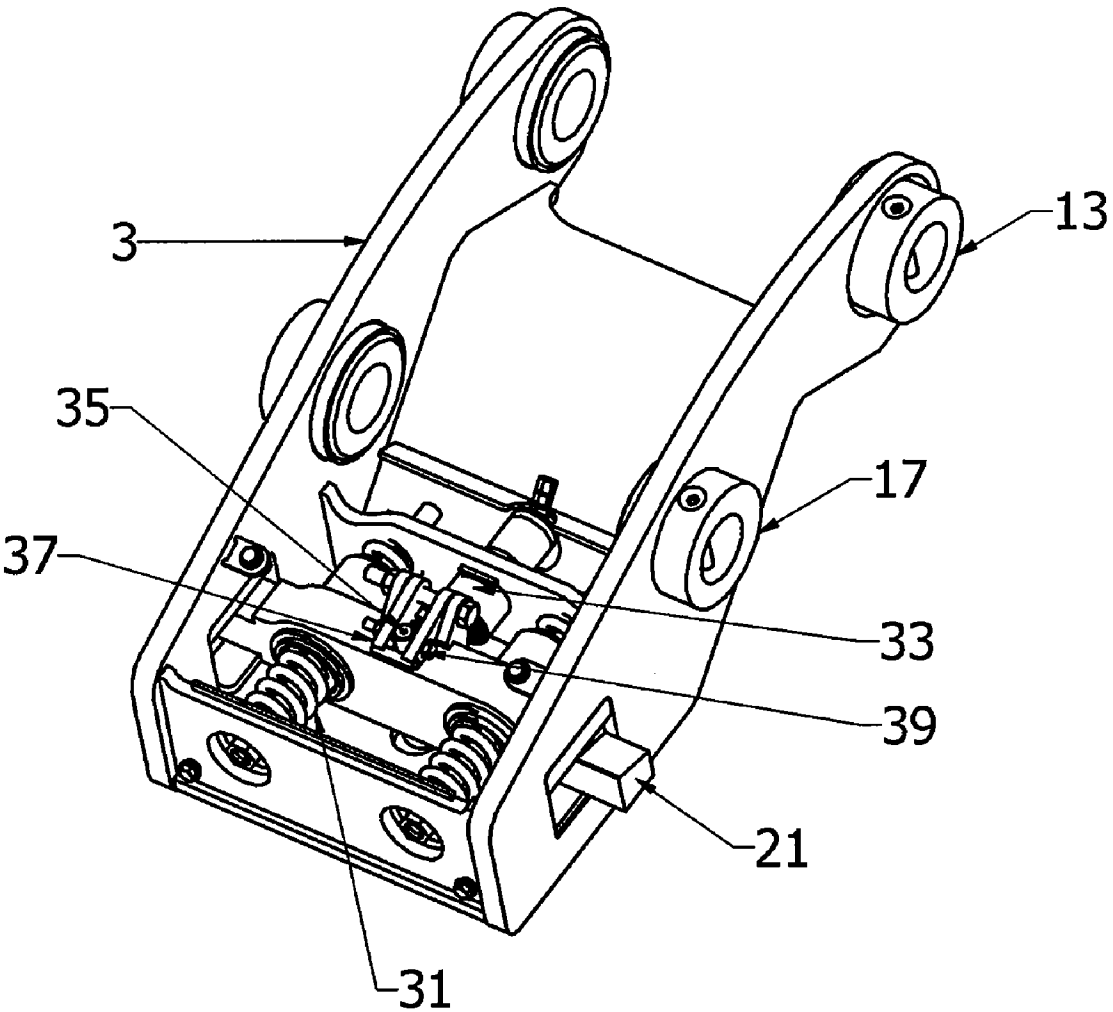
FIG. 6 is a perspective cut away view of the apparatus of FIG. 1 showing the latching and wedge positioning mechanism.

The coupler 3 and mounting brackets 11 are configured such that when the first and second sets of lugs 13, 17 are in full engagement with the corresponding first and second sets of recesses 15, 19 the bucket 9 is properly oriented with respect to the hoe arm, as illustrated in FIG. 1. A bias element on the coupler member 3 continuously exerts a bias force on a wedge 21 mounted on the coupler member 3, and an actuator, illustrated as a single acting hydraulic actuator cylinder 33, selectively exerts an actuator force AF only in a direction opposite to the wedge bias force WF. The actuator force AF is greater than the bias force WF so that when pressurized hydraulic fluid is directed into the cylinder 33, the cylinder exerts the force AF and the wedge moves against the bias force toward the open position of FIG. 4. When the pressurized hydraulic fluid is released from the cylinder 33, the actuator force AF is no longer present and the bias force moves the wedge 21 from the open position as shown in FIG. 4 toward a closed position where the wedge 21 is engaged in grooves 23 on the mounting brackets 11 as shown in FIG. 5. The single acting hydraulic actuator cylinder 33 exerts a force only in the direction AF toward the open position, and is not operative to exert any force on the wedge 21 toward the closed position.

The wedge 21 and grooves 23 are configured such that as the wedge 21 moves into the grooves 23 the tapered sides 25 of the wedge 21 bear against corresponding tapered sides 27 of the grooves 23. The wedge 21 is forced into the grooves 23 by the bias force WF and the force of the tapered wedge 21 bearing against the correspondingly tapered grooves 23 draws the second lugs 17 into the second recesses 19 to substantially rigidly connect the coupler member 3 and the mounting bracket 11. When the wedge 21 has moved to the fully engaged closed position with respect to the grooves 23 as shown in FIG. 5, a latch member, described below, is moved to a latched position and engages a catch member to prevent the wedge 21 from moving out of the groove 19.

FIGS. 6-9 illustrate the interior mechanism of the apparatus 1. A wedge bias element, illustrated as a pair of springs 31, is configured to continuously exert a wedge bias force WF on the wedge 21 towards the groove such that the wedge bias force WF forces the wedge 21 into the groove. The wedge bias force is sufficient, when the wedge is in the closed position, to maintain the wedge in the closed position. The single acting hydraulic actuator cylinder 33, is configured to selectively exert or release an actuator force AF in a direction opposite to the wedge bias force WF. Directing pressurized fluid into the single acting hydraulic actuator cylinder 33 extends the cylinder 33 and exerts an actuator force AF greater than the wedge bias force WF such that the wedge is maintained in the open position, illustrated in FIG. 7, while engaging the first and second lugs 13, 17 on the coupler member 3 into engagement in the first and second recesses 15, 19 on the mounting bracket 11 as shown in FIGS. 2, 3, and 4. The pressurized fluid is then released from the single acting hydraulic actuator cylinder 33, removing the actuator force AF and releasing the springs 31. With no pressurized hydraulic fluid present, the cylinder 33 retracts in response to the wedge bias force WF and the bias force WF then moves the wedge 21 to the closed position of FIG. 8 and thus into the groove 23 as shown in FIG. 5.

To reduce the risk that the wedge 21 might be dislodged from the groove 23, thus allowing the bucket to fall off the hoe arm, a remotely operated safety latch is provided. The wedge 21, hydraulic actuator cylinder 33, and safety latch are configured such that activating the hydraulic actuator cylinder 33 moves the safety latch to an unlatched position prior to exerting the actuator force AF on the wedge 21. A latch member moves to a latched position and engages a catch member to prevent the wedge 21 from moving out of the position of FIGS. 8 and 9. In the illustrated embodiment the latch member is a safety pin 35 pivotally attached at a top end thereof to a pin arm 37. A bias element such as a spring, resilient member, or the like is operative to exert a downward latch bias force LF on the safety pin 35 toward the latched position. The pin arm 37 pivots about an arm pivot axis APA, and the end of the hydraulic actuator cylinder 33 bears against the lower portion 38 of the pin arm 37. Thus the configuration of the pin arm 37 is such that when pressurized fluid is present in the hydraulic actuator cylinder 33, the actuator force AF overcomes the latch bias force LF and maintains the safety pin 35 in the up and unlatched position of FIGS. 7 and 8. The remotely operated latch control is thus provided by an actuator control operative to activate the single acting actuator. Alternatively the safety pin could be moved by a solenoid arrangement, or like mechanism as is known in the art.

When the pressurized hydraulic fluid is released from the hydraulic actuator cylinder 33, the actuator force AF is removed and the wedge 21 moves into engagement with the groove, the bottom end of the safety pin 35 moves into alignment with a corresponding pin aperture 41 on the coupler member 3 that acts as the catch for the latch. When the wedge 21 has moved to the fully engaged closed position illustrated in FIG. 8 the safety pin 35 and pin aperture 41 are aligned and in response to the latch bias force LF, the hydraulic actuator cylinder 33 retracts further releasing the safety pin 35 to move into the pin aperture 41 as illustrated in FIG. 9, and prevent the wedge 21 from moving out of engagement with the groove.

Figure 7:
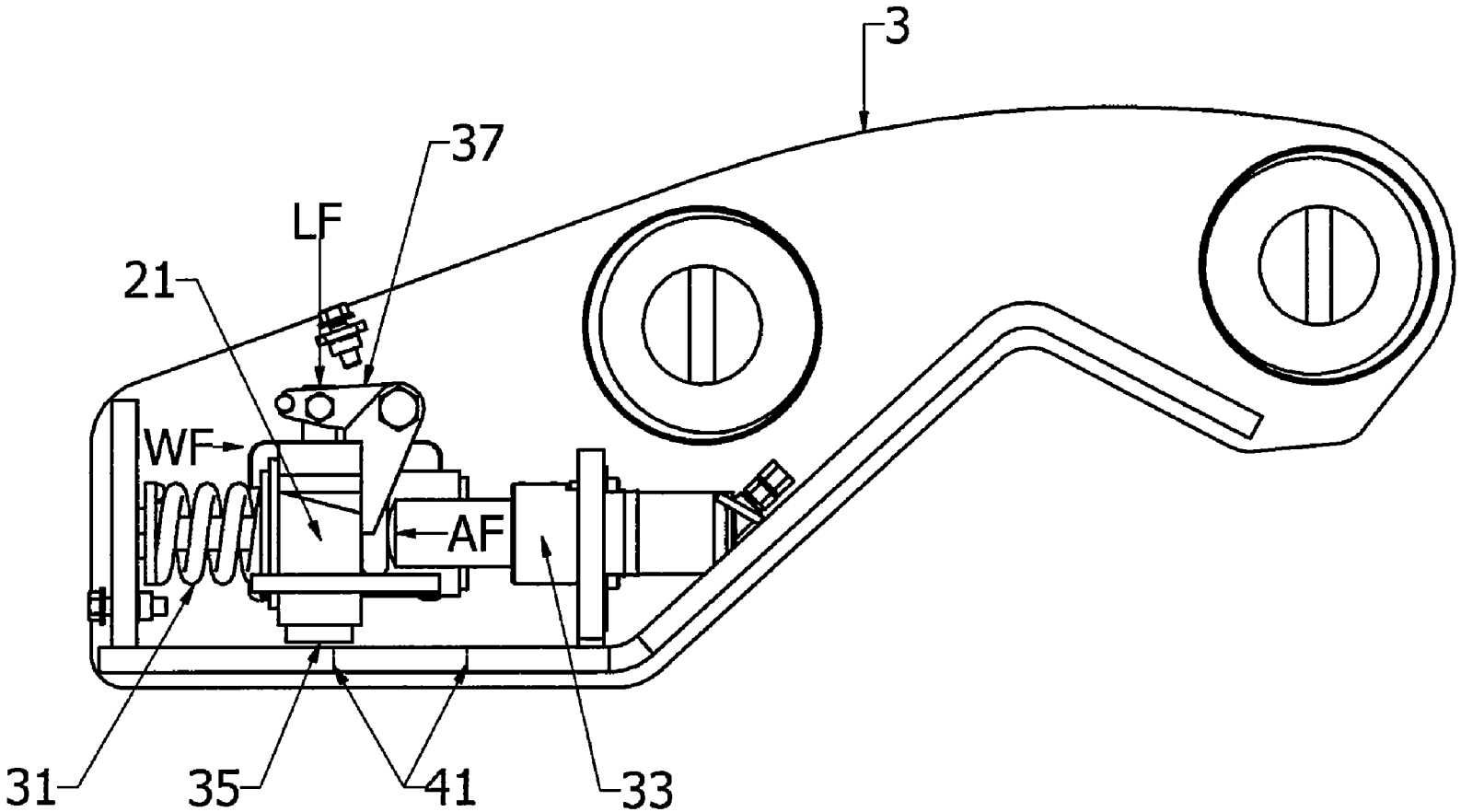
FIGS. 7-9 are side views of the embodiment of FIG. 6 showing the wedge moving from the open position of FIG. 7 to a closed and latched position of FIG. 9.
Figure 8:
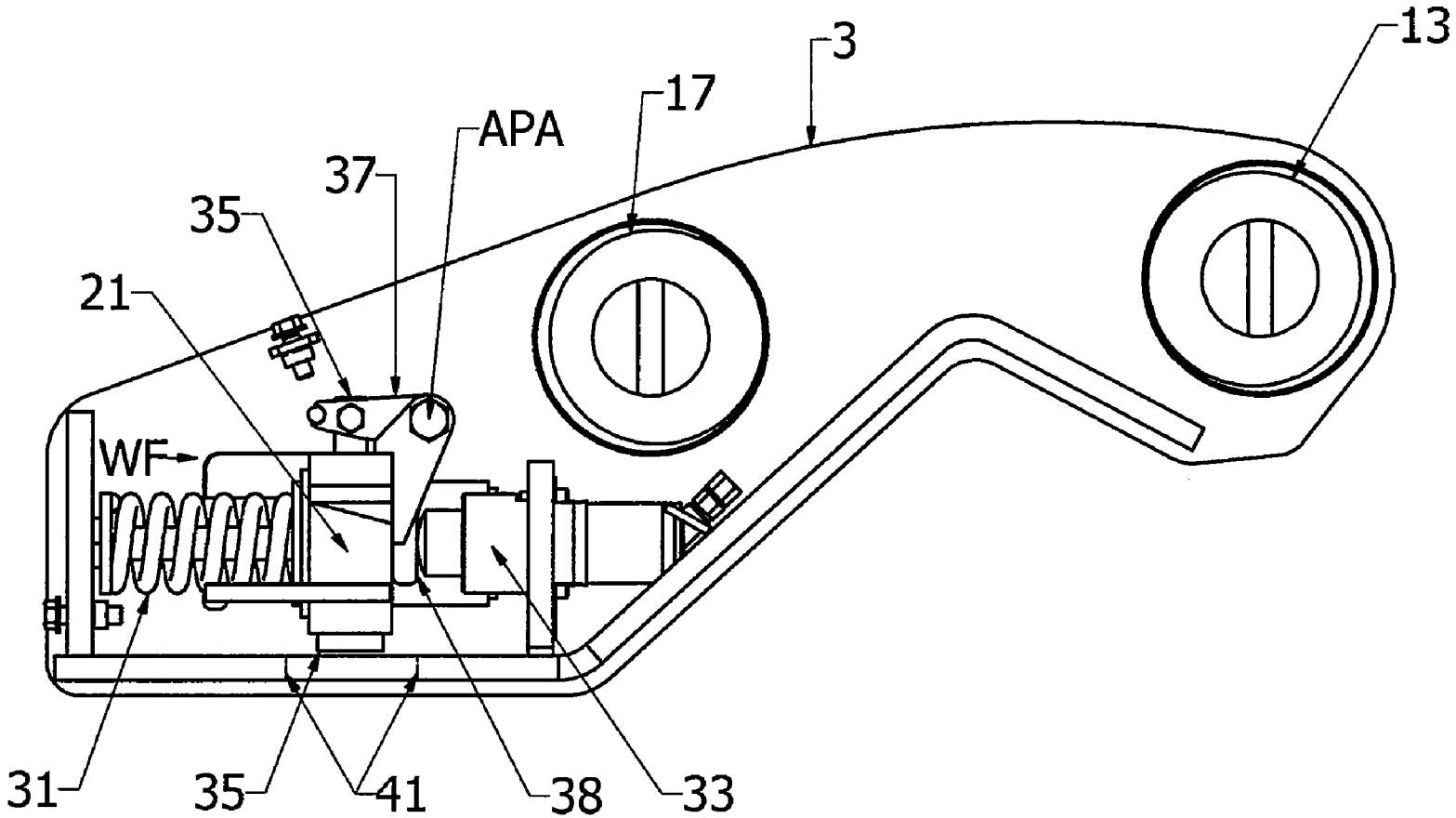
Figure 9:
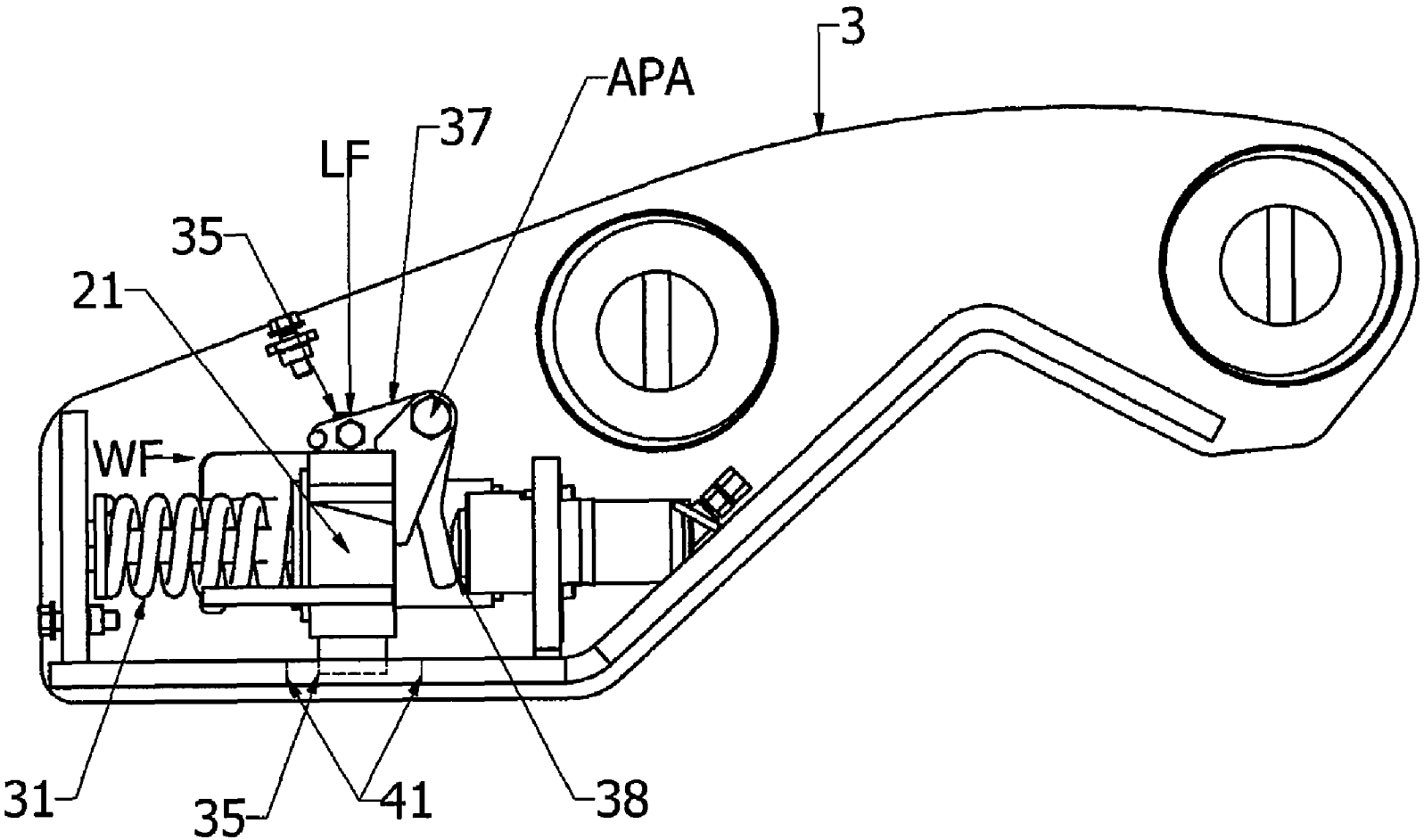
Figure 10:
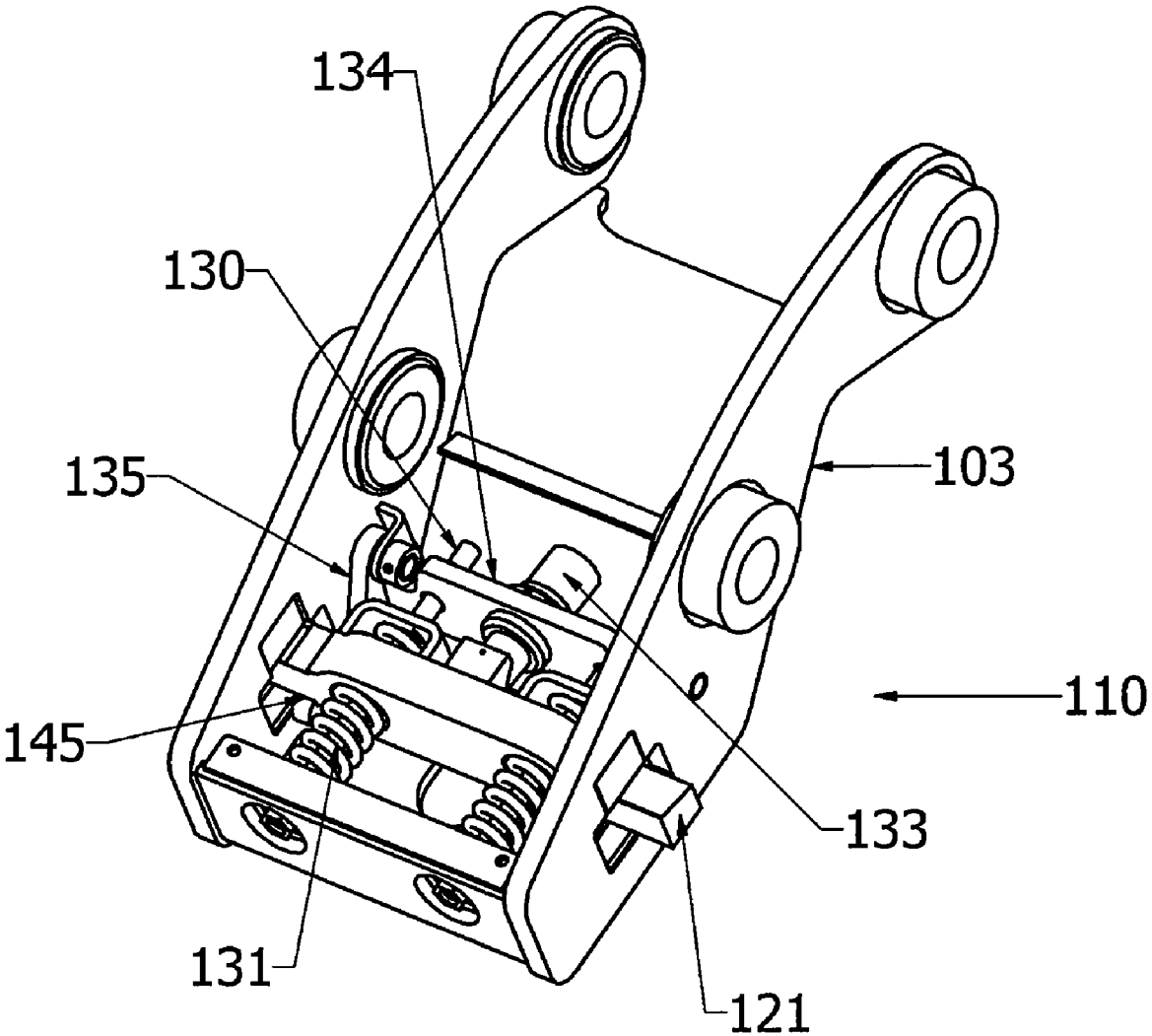
FIG. 10 is a perspective cut away view of an alternate embodiment of the quick coupling apparatus of the present invention showing the latching and wedge positioning mechanism.

The single acting hydraulic actuator cylinder 33 thus is configured to operate the latch and also move the wedge from the closed position of FIG. 9 to the open position of FIG. 7. When it is desired to release the coupler member 3 from the mounting brackets 11, pressurized fluid is directed into the single acting hydraulic actuator cylinder 33 and as the cylinder 33 extends it first contacts the pin arm 37 and moves the safety pin 35 up out of the pin aperture 41, so that extending the cylinder 33 further can then move the wedge 21 out of the groove and into the open position of FIG. 7 where the coupler member and mounting bracket are released from each other.

Figure 14:
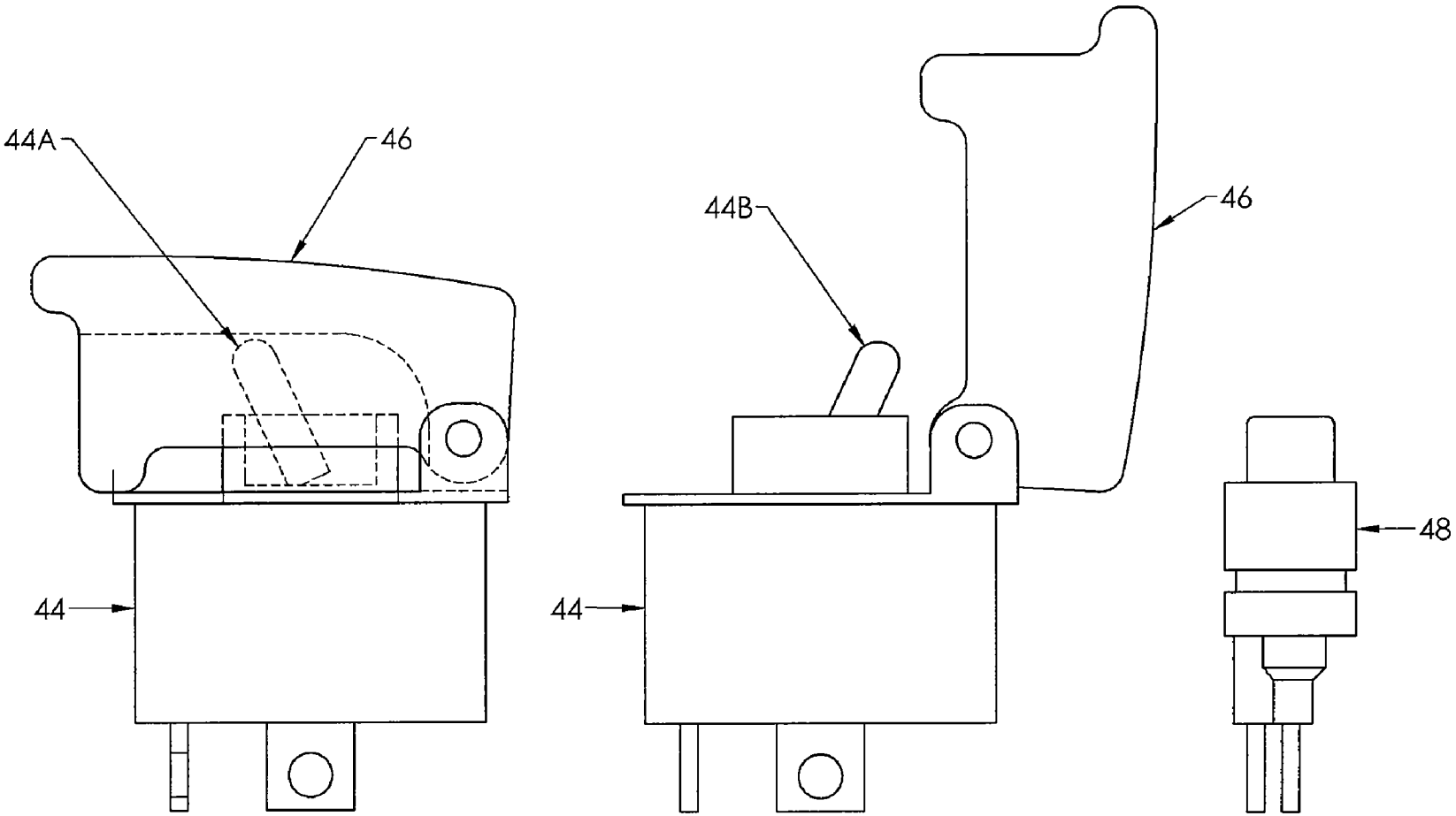
FIG. 14 schematically illustrates an actuator control comprising a covered switch in the closed and open positions.

In order to prevent accidental activation of the single acting hydraulic actuator cylinder 33 and accidental release of the bucket, a safety switch is provided at the operator's position for the control directing pressurized fluid into the hydraulic cylinder. For example, as schematically illustrated in FIG. 14, the hydraulic control may be operated by a switch 44 shown in an off position 44A covered by a safety cover 46, and in an on position 44B with the cover 46 open. For improved safety, an audible or visible alarm 48 may be activated when the switch 44 is in the on position 44B, thus alerting the operator that the bucket connection is not secure.

A separate arming switch, or like safety switch can be provided to reduce the risk that the control will be operated to direct pressurized hydraulic fluid into the single acting hydraulic actuator cylinder 33 accidentally.

The apparatus is configured so that the wedge 21 is only forced to the open position when pressurized hydraulic fluid is directed to the single acting hydraulic actuator cylinder 33. Thus an alarm can be configured to be activated by a pressure sensor in the hydraulic conduit between the control and the single acting hydraulic actuator cylinder 33 when pressurized fluid is present.

Figure 15:
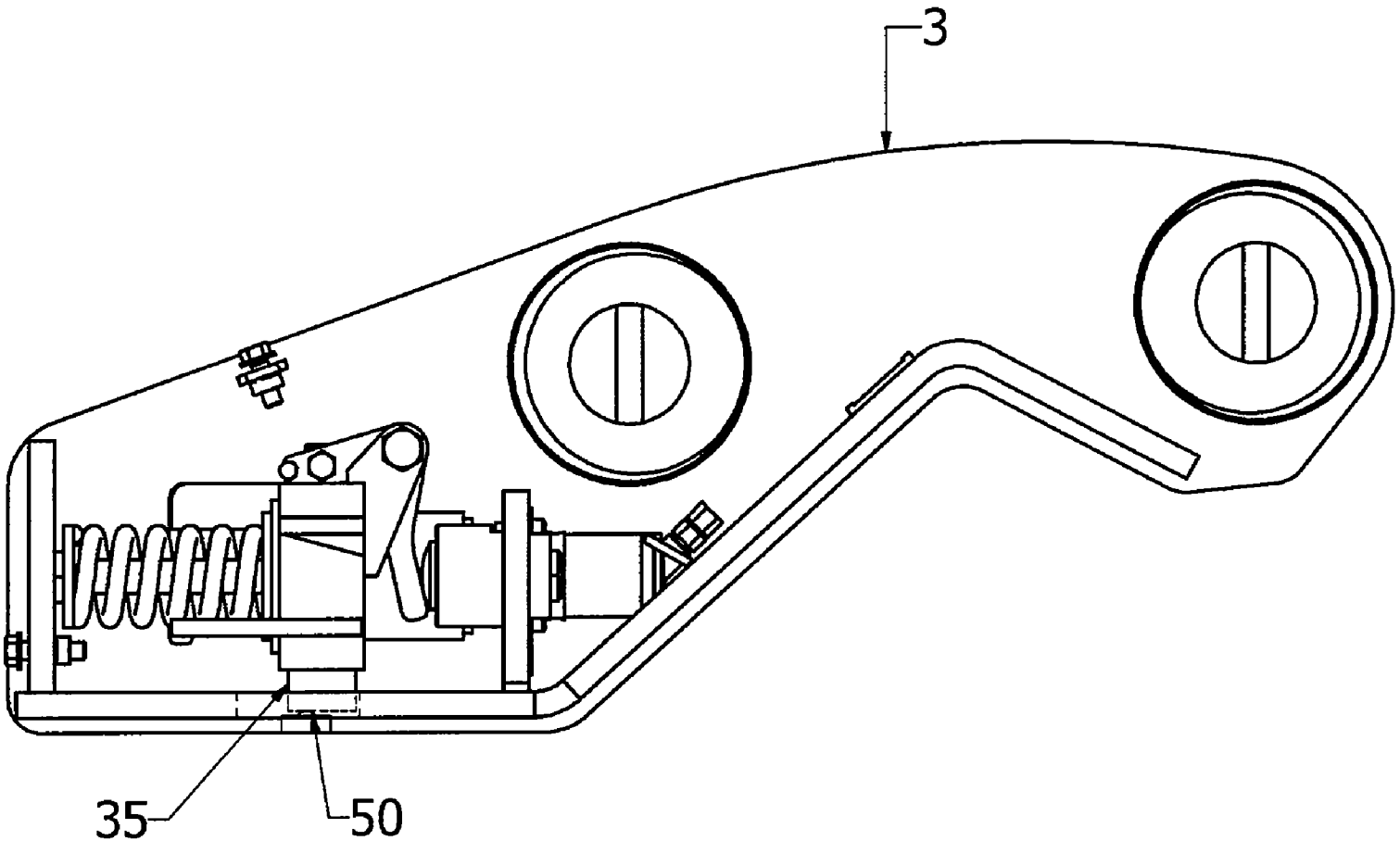
FIG. 15 schematically illustrates a mechanism to indicate when the safety latch is engaged.

Further to reduce the risk of accidental disengagement, an indicator can be provided to visually indicate to the operator that the latch, the safety pin 35 in the embodiment of FIGS. 6-9, is in the latched position and the coupler 3 is safely locked to the mounting brackets 11. For example as schematically illustrated in FIG. 15, the safety pin 35 contacts a switch 50 that is connected to activate an indicator, such as the alarm 48 in FIG. 14. The indicator could also be a flag attached to the coupler or the like.

FIGS. 10-13 illustrate the interior mechanism of an alternate embodiment of the quick coupling apparatus 110. A wedge bias element, illustrated as a pair of springs 131, is oriented to exert a wedge bias force WF on the wedge 121 rearward towards the groove such that the wedge bias force WF forces the wedge 121 into the groove. A hydraulic single acting actuator cylinder 133 is configured to selectively exert or release an actuator force AF in a direction opposite to the wedge bias force WF. Directing pressurized fluid into the hydraulic actuator cylinder 133 exerts an actuator force AF greater than the wedge bias force WF such that the wedge is maintained in the open position, illustrated in FIG. 11. The pressurized fluid is then released from the hydraulic actuator cylinder 133, removing the actuator force AF and the bias force WF then moves the wedge 121 to the closed position of FIG. 12.

In the illustrated apparatus 110 of FIGS. 10-13 the latch member is a latch arm 135 fixed to a rocker plate 134, to which the hydraulic actuator cylinder 133 is also fixed. The latch arm 135 and hydraulic actuator cylinder 133, via the rocker plate 134, are pivotally attached to the coupler member 103 about a latch pivot axis LPA. Bolts 130 through springs 131 are operative to exert a moment M on the rocker plate 134, and thus on the hydraulic actuator cylinder 133 and the latch arm 135, about the latch pivot axis LPA such that the hook 145 at the end of the latch arm 135 is urged upward toward the latched position of FIG. 13 where the hook 145 lies behind the wedge 121 and prevents the wedge from moving out of the closed position. With no pressure in the hydraulic actuator cylinder 133, the moment M also rotates the front end of the cylinder rod 147 of the hydraulic actuator cylinder 133, which is fixed to the latch arm 135, upward to the position illustrated in FIG. 13 where the end of the rod 147 is pushed out of the recess 149 that is shaped to correspond to the end of the rod 147.

Figure 11:
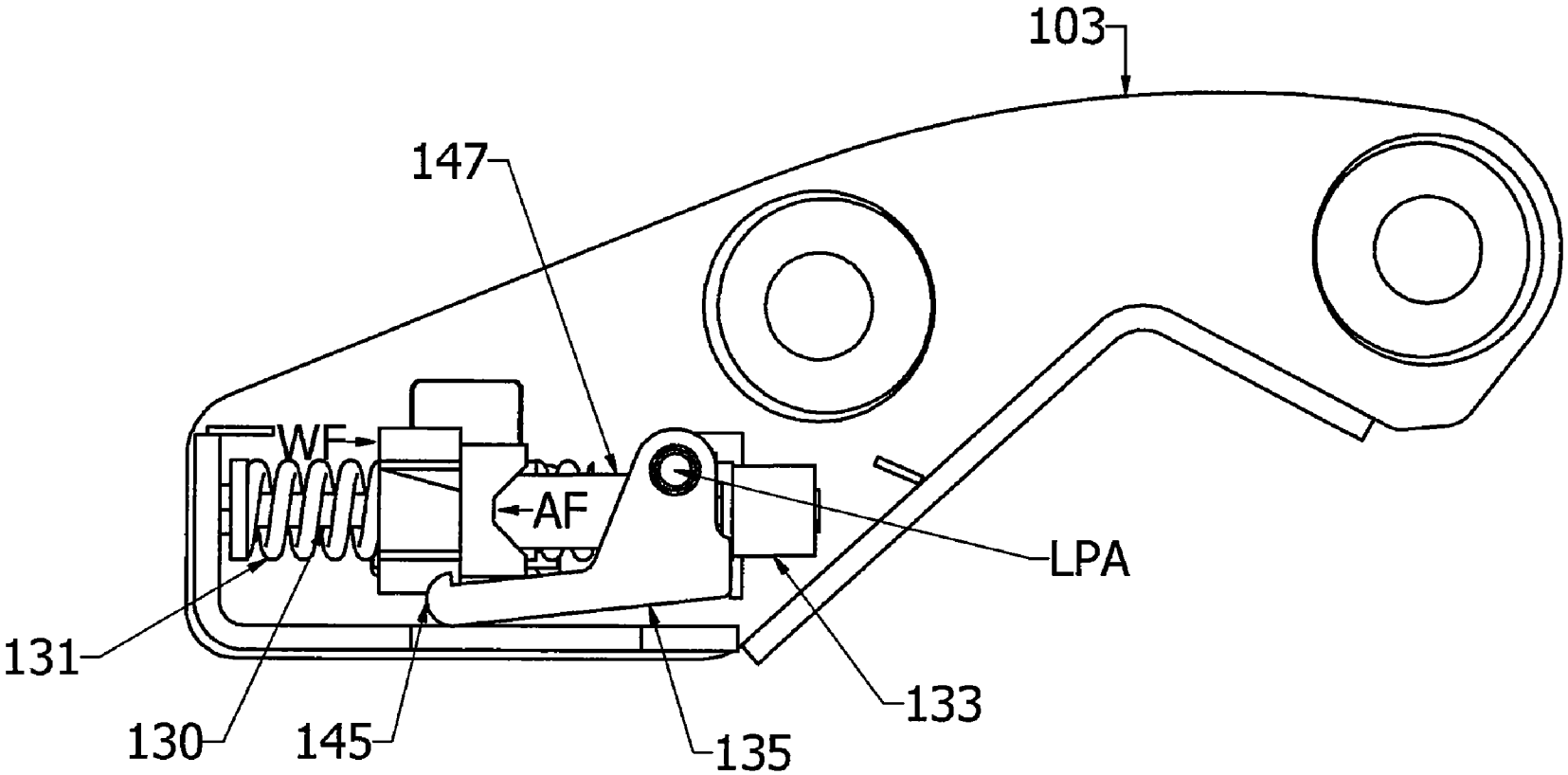
FIGS. 11-13 are side views of the embodiment of FIG. 10 showing the wedge moving from the open position of FIG. 11 to a closed and latched position of FIG. 13
Figure 12:
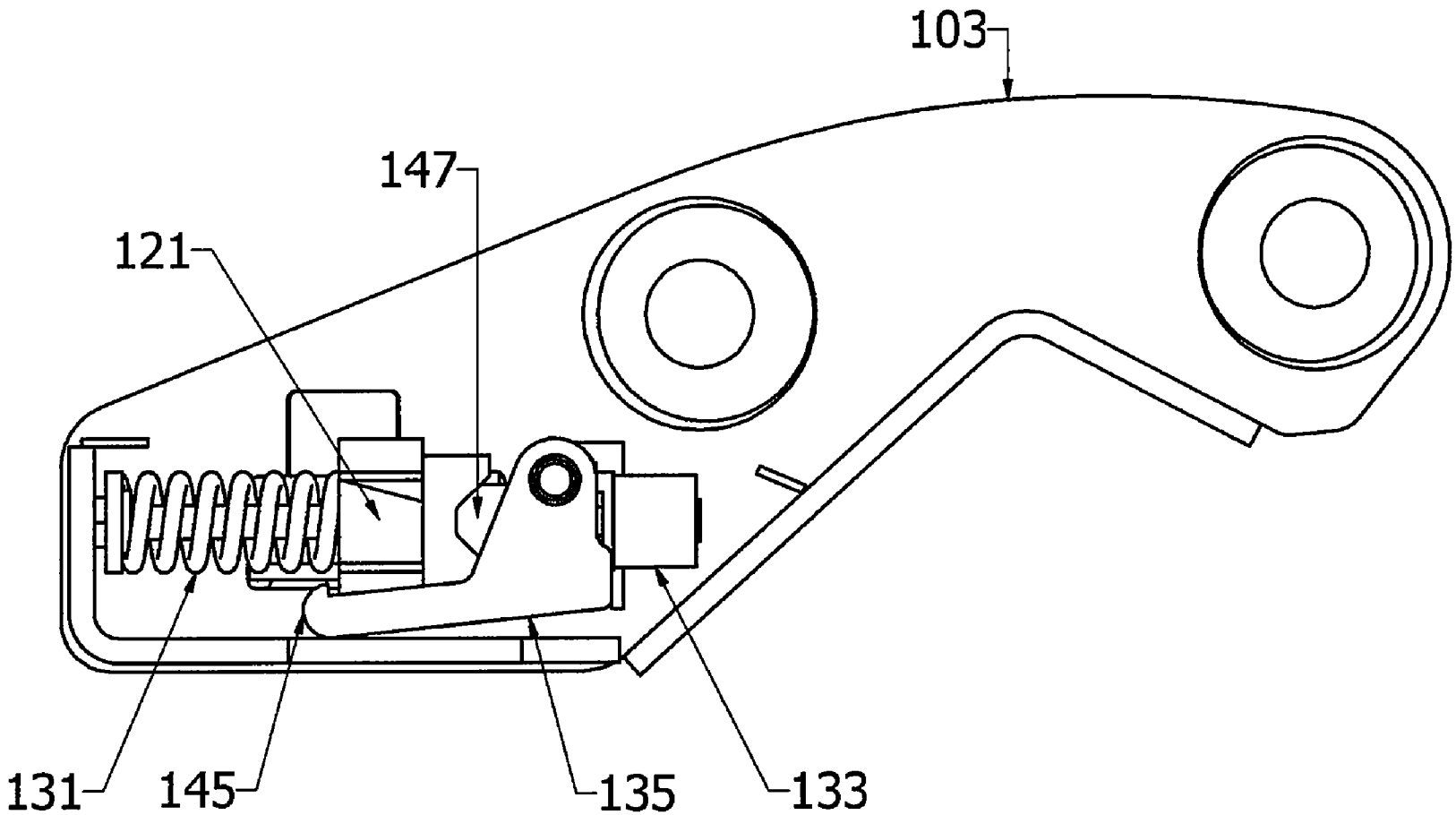
Figure 13:
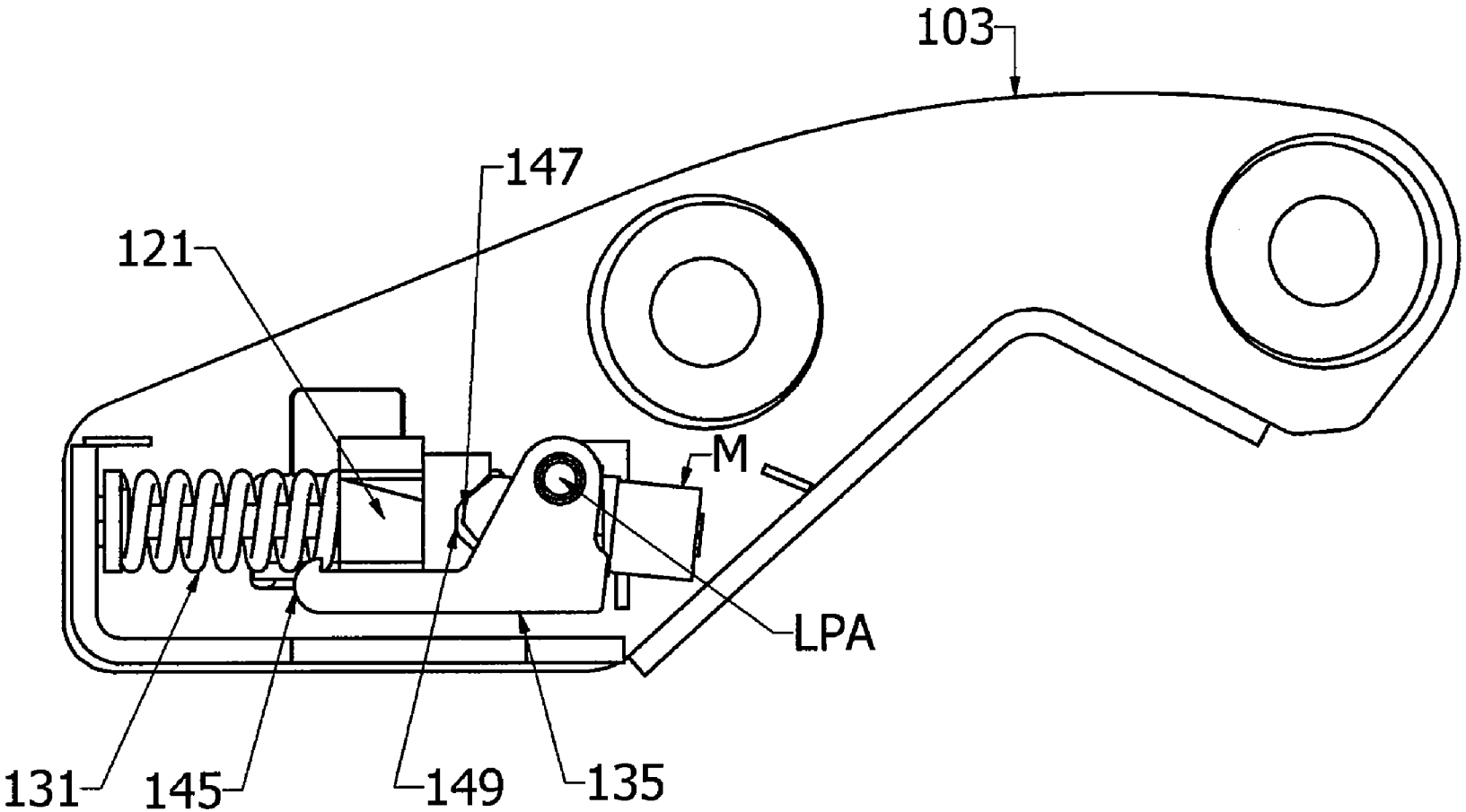

When pressurized fluid is directed into the hydraulic actuator cylinder 133, the rod 147 moves outward and is forced downward into the recess 149, which also moves the latch arm 135 downward such that the hook 145 no longer prevents the wedge from moving out of the closed position of FIG. 13 to the open position of FIG. 12, and then the actuator force AF exerted by the hydraulic actuator cylinder 135 can push the wedge 121 to the open position of FIG. 11.

Thus again the hydraulic actuator cylinder 133 thus is configured to operate the latch and also move the wedge from the closed position of FIG. 13 to the open position of FIG. 11. When it is desired to release the coupler member 103 from the mounting brackets, pressurized fluid is directed into the hydraulic actuator cylinder 133 and as the rod 147 extends it first moves down into the recess 149, thereby moving the latch arm 135 down and the hook away from the wedge 121 so that extending the rod 147 further can then move the wedge 121 out of the groove and into the open position of FIG. 11 where the coupler member and mounting bracket are released from each other.

Figure 16:
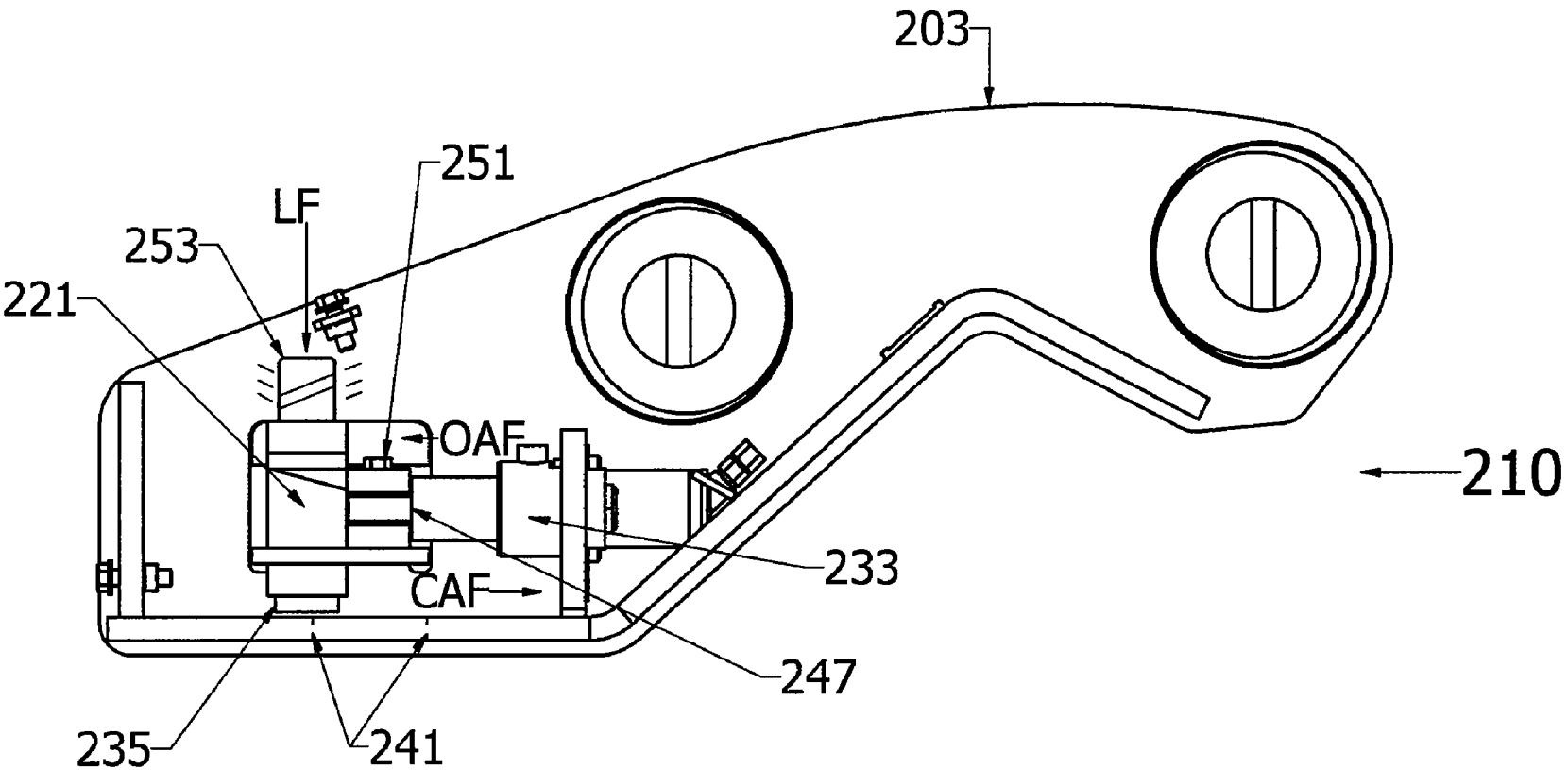
FIGS. 16-18 are side views of an alternate embodiment of the quick coupling apparatus of the present invention using a double acting hydraulic cylinder and illustrating the wedge moving from the open position of FIG. 16 to a closed and latched position of FIG. 18.
Figure 17:
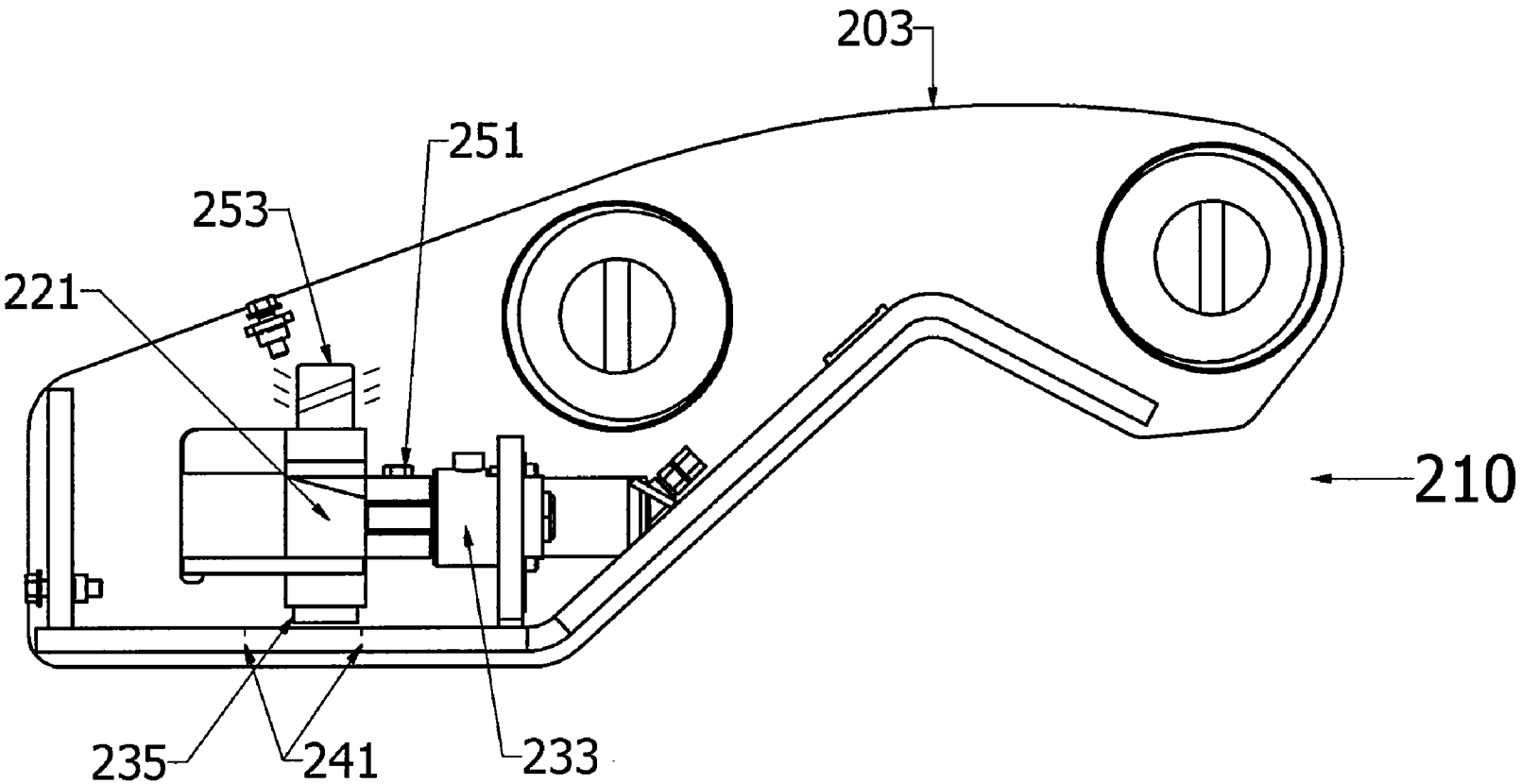
Figure 18:
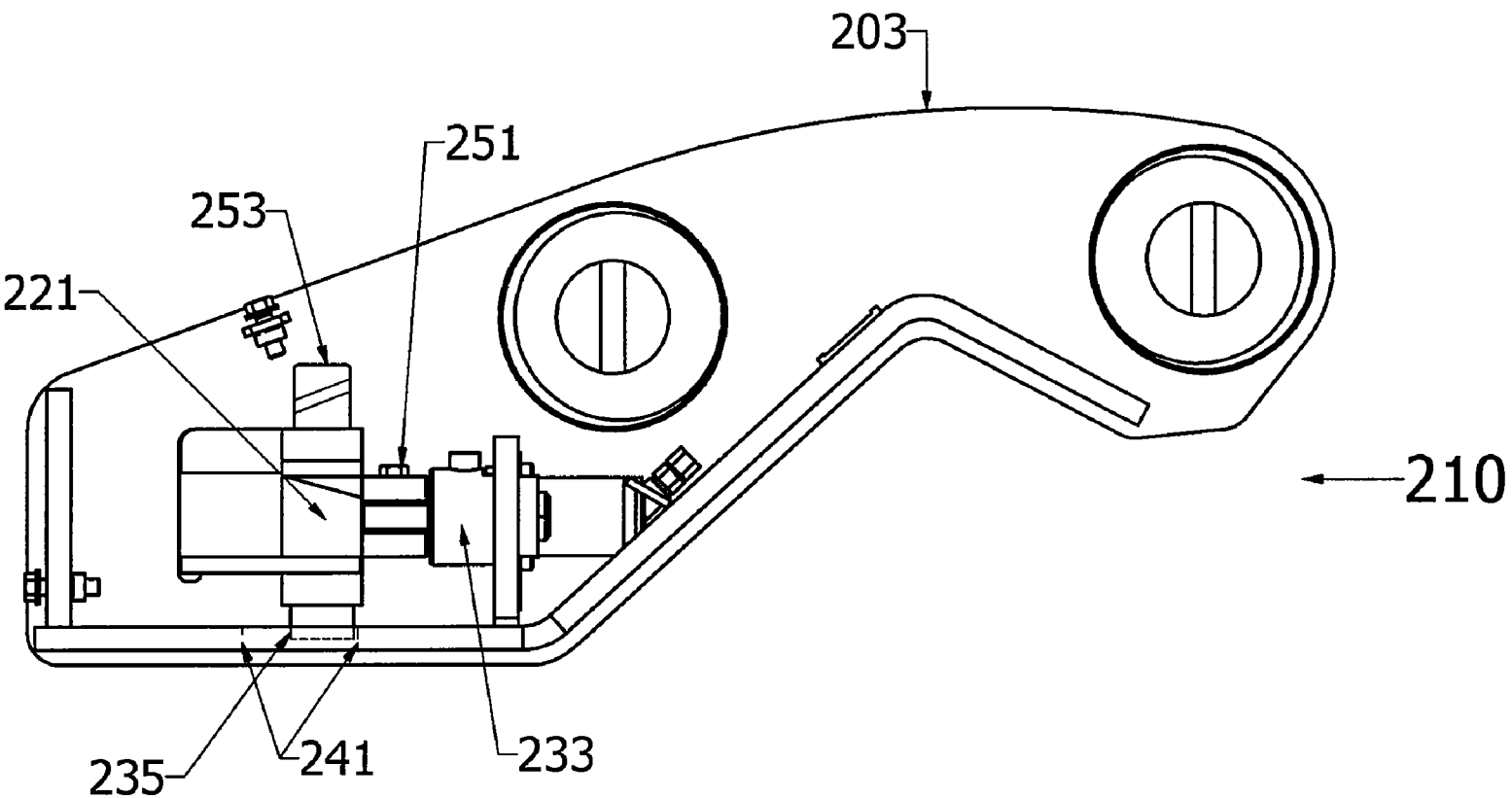

FIGS. 16-18 illustrate an alternative embodiment of the quick coupling apparatus 210 of the invention comprising a coupler member 203 and a wedge 221 similar to those in the apparatuses 1, 110 above. In the apparatus 210, the wedge positioning mechanism comprises a double acting extendable actuator 233. The end of the cylinder rod 247 is connected to the wedge 221 by a pin 251 so that extending or retracting the double acting actuator 233 selectively exert an opening actuator force OAF on the wedge 221 to move the wedge 221 to the open position of FIG. 16, or a closing actuator force CAF on the wedge to move the wedge 221 to the closed position of FIGS. 17 and 18.

A remotely operated latch control at the operator's station operates a solenoid 253 to selectively exert the latch force LF to move the safety pin 235 between the unlatched position of FIG. 17 and the latched position of FIG. 18 where the pin 235 is located in the a corresponding pin aperture 241 on the coupler member 203.

Figure 19:
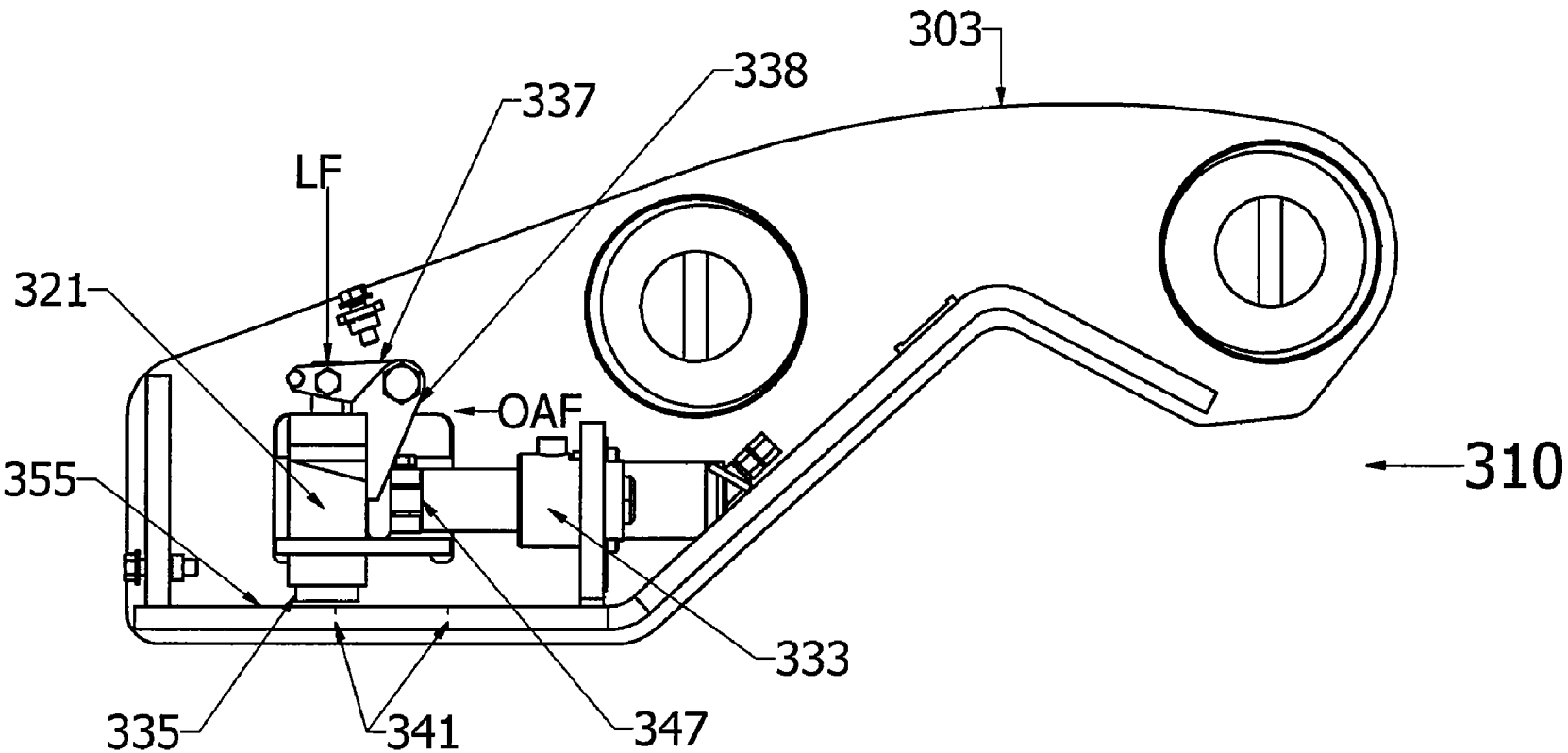
FIGS. 19-21 are side views of a further alternate embodiment of the quick coupling apparatus of the present invention using a double acting hydraulic cylinder and illustrating the wedge moving from the open position of FIG. 19 to a closed and latched position of FIG. 21.
Figure 20:
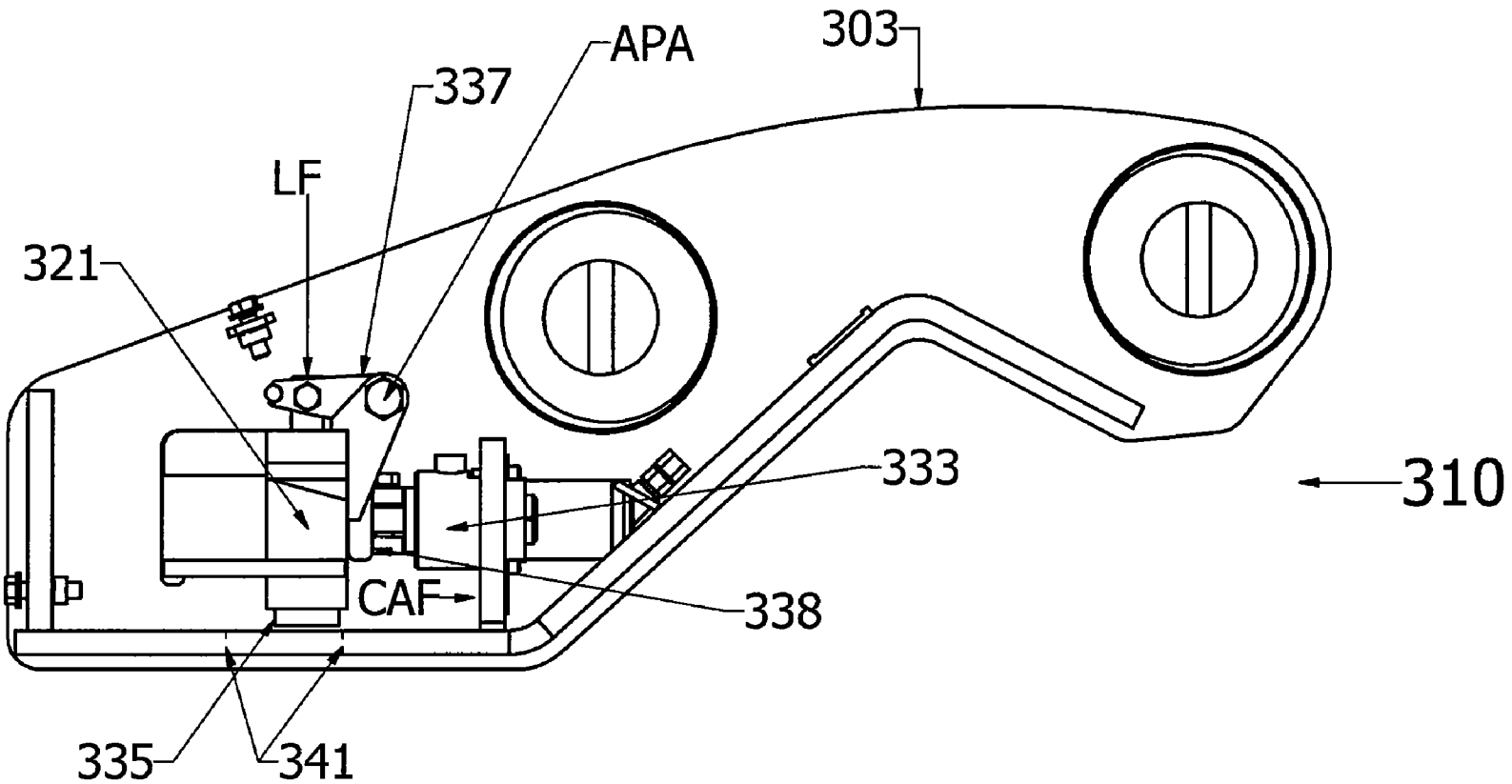
Figure 21:
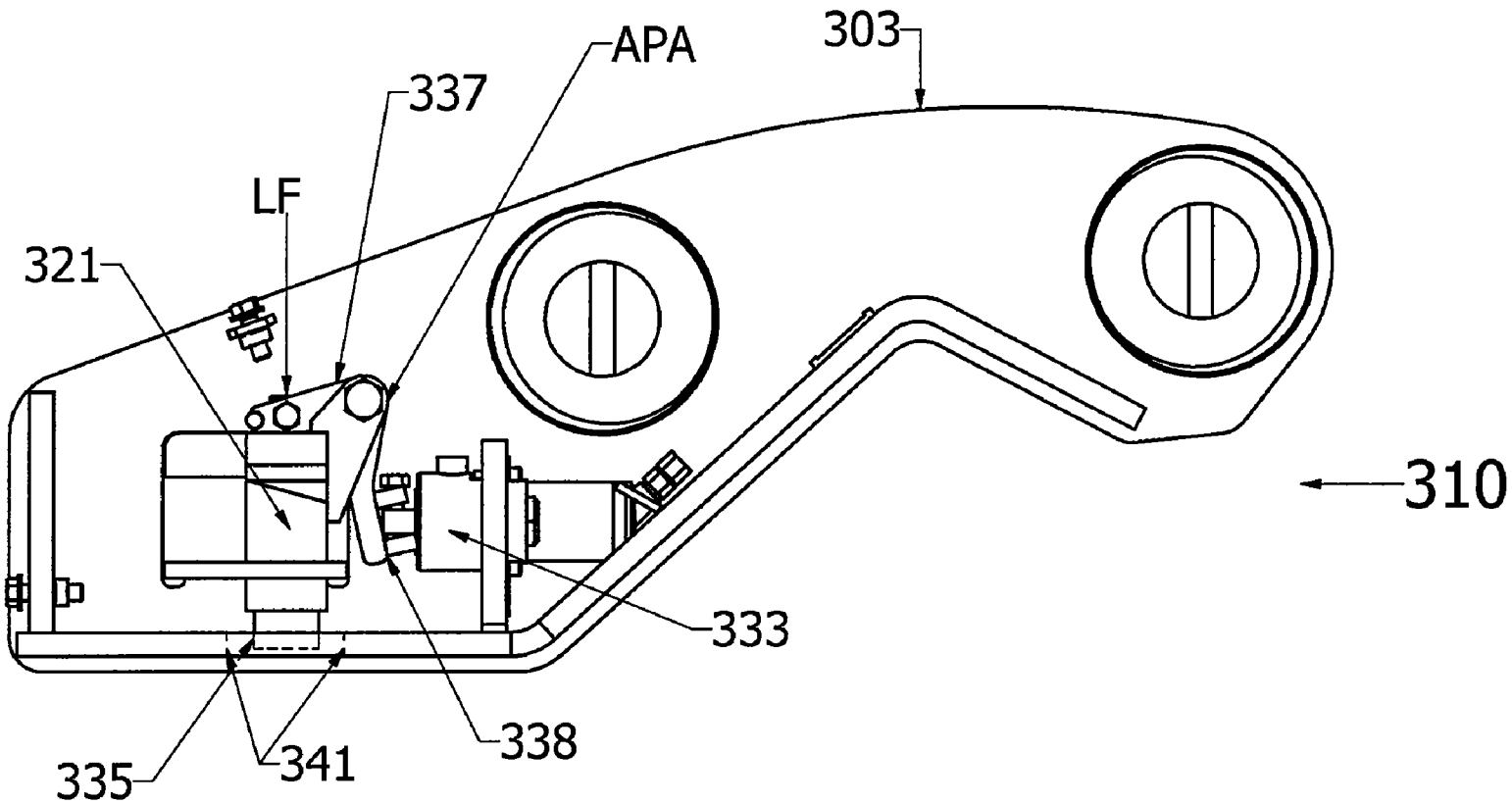

FIGS. 19-21 illustrate a further alternative embodiment of the quick coupling apparatus 310 of the invention comprising a coupler member 303 and a wedge 321 similar to those in the apparatuses 1, 110, 210 above. In the apparatus 310, the wedge positioning mechanism also uses a double acting extendable actuator cylinder 333 so that extending or retracting the double acting actuator 333 moves the wedge 321 between the open position of FIG. 19 and the closed position of FIGS. 20 and 21.

Similar to the arrangement shown in FIGS. 6-9, a safety pin 335 pivotally attached at a top end thereof to a pin arm 337. The pin arm 337 in turn pivots about an arm pivot axis APA, and the end of the rod 347 of the double acting hydraulic actuator cylinder 333 is attached to the lower portion 338 of the pin arm 337 by a pin 351. Thus the configuration of the pin arm 337 is such that when the double acting actuator cylinder 333 is retracting and exerting a closing force CAF on the lower portion 338 of the pin arm 337, a downward latching force is exerted on the safety pin 335 and the bottom end of the safety pin 335 bears against the plate 355. When the safety pin 335 is bearing against the plate 355, further retraction of the double acting actuator cylinder 333 in the direction of the closing force CAF pulls the wedge 321 toward the closed position. As the wedge 321 moves toward the closed position, the bottom of the safety pin 355 slides along the plate until the wedge 321 reaches the closed position shown in FIG. 20, at which time the safety pin 335 is aligned with, and moves down into, the pin aperture 341 as shown in FIG. 21.

When the double acting actuator cylinder 333 is extended, the rod 347 exerts the opening force OAF on the lower portion 338 of the pin arm 337 which pivots the pin arm to move the safety pin 335 up out of the pin aperture 41. When the safety pin 335 is out of the pin aperture 341, the extending rod 347 pushes the wedge to the open position of FIG. 19.

The present invention thus provides a method of coupling a tool to a tool arm of a tool manipulating machine. The method comprises attaching a coupler member 3 to the tool arm 6, and providing a mounting bracket 11 extending out from the tool; providing a wedge 21 movably mounted on the coupler member 3 such that the wedge 21 can move from an open position to a closed position, and providing a wedge positioning mechanism operative to selectively move the wedge between the closed position and the open position.

With wedge in the open position manipulating the coupler member 3 into engagement with the mounting bracket 11, and operating the wedge positioning mechanism to move the wedge 21 from the open position to the closed position where the wedge 21 is engaged in a groove 23 on the mounting bracket 11 and where a tapered side 25 of the wedge 21 bears against a corresponding tapered side 27 of the groove 23 to draw the coupler member 3 into engagement with the mounting bracket 11 as the wedge 21 moves toward the closed position.

A safety latch is provided and configured such that when the wedge 21 moves into the groove 23 and reaches the closed position, the safety latch can move to a latched position and prevent the wedge 21 from moving toward the open position. With a remote control, the safety latch is moved to the latched position;

When it is desired to release the tool from the tool arm, the remote control is used to move the safety latch to an unlatched position, and the wedge positioning mechanism is operated to move the wedge to the open position.

Further with the coupler apparatus of the present invention, a first tool can be disengaged and a second tool engaged by an operator without leaving the operator station.

The foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A quick coupling apparatus for coupling a tool to a tool arm of a tool manipulating machine, the apparatus comprising:

a coupler member adapted to be attached to the tool arm, and configured to engage a mounting bracket extending out from the tool;

a wedge mounted on the coupler member and movable, when the coupler member and mounting bracket are engaged, from a closed position where the wedge is engaged in a groove on the mounting bracket and where a tapered side of the wedge bears against a corresponding tapered side of the groove to draw the coupler member into engagement with the mounting bracket, to an open position where the wedge is removed from the groove;

a wedge bias element operative to continuously exert a wedge bias force on the wedge towards the closed position and into the groove, and operative to exert the wedge bias force on the wedge when the wedge is in the closed position such that the wedge bias force maintains the wedge in the closed position;

a safety latch, and a latch bias element operative to exert a latch bias force urging the safety latch to a latched position, the safety latch configured such that when the wedge moves into the groove and reaches the closed position, the safety latch can move from an unlatched position to the latched position to prevent the wedge from moving toward the open position;

a single acting hydraulic cylinder configured such that when pressurized fluid is directed into the hydraulic cylinder, the hydraulic cylinder extends and the hydraulic cylinder first contacts the safety latch and exerts a force moving the safety latch to the unlatched position, further extension of the hydraulic cylinder causing the hydraulic cylinder to exert a force on the wedge in a direction substantially opposite to the wedge bias force to move the wedge toward the open position;

the single acting hydraulic cylinder configured such that when pressurized fluid is released from the hydraulic cylinder, the hydraulic cylinder retracts and the wedge moves into the groove in response to the wedge bias force until the wedge reaches the closed position, and then the hydraulic cylinder further retracts and the safety latch moves to the latched position in response to the latch bias force; and a remotely operated control operative to selectively direct pressurized fluid into the hydraulic cylinder and release pressurized fluid from the hydraulic cylinder.

2. The apparatus of claim 1 wherein the safety latch comprises a safety pin that engages a pin aperture when in the latched position, wherein the safety pin is pivotally attached at a top end thereof to a pin arm such that movement of the pin arm causes movement of the safety pin into or out of the pin aperture, and wherein an end of the hydraulic cylinder bears against the pin arm.

3. The apparatus of claim 1 comprising a safety switch in an operator's position on the tool manipulating machine and operative, when in a safe position, to prevent activation of the control.

4. The apparatus of claim 1 comprising an indicator operative to indicate to an operator that the safety latch is in the latched position.

5. A hoe excavator apparatus comprising:

a hoe arm and a coupler member attached by a first pin through an end of the hoe arm;

a hydraulic cylinder pivotally attached at one end to the hoe arm and at an opposite end to the coupler member by a second pin parallel to the first pin;

a tool with a mounting bracket extending from the tool and defining a groove;

a first lug on the coupler member configured to engage with a first recess on the mounting bracket, and a second lug on the coupler member configured to engage a second recess on the mounting bracket;

wherein the coupler and mounting brackets are configured such that when the first and second lugs are engaged with the corresponding first and second recesses the tool is properly oriented with respect to the hoe arm;

a wedge mounted on the coupler member and movable, when the coupler member and mounting bracket are engaged, from a closed position where the wedge is engaged in the groove on the mounting bracket and where a tapered side of the wedge bears against a corresponding tapered side of the groove to draw the first and second lugs into engagement with the corresponding first and second recesses, to an open position where the wedge is removed from the groove;

a wedge bias element operative to continuously exert a wedge bias force on the wedge towards the closed position and into the groove, and operative to exert the wedge bias force on the wedge when the wedge is in the closed position such that the wedge bias force maintains the wedge in the closed position;

a safety latch, and a bias element operative to exert a latch bias force urging the safety latch to a latched position, the safety latch configured such that when the wedge moves into the groove and reaches the closed position, the safety latch can move from an unlatched position to the latched position to prevent the wedge from moving toward the open position;

a single acting hydraulic cylinder configured such that when pressurized fluid is directed into the hydraulic cylinder, the hydraulic cylinder extends and the hydraulic cylinder first contacts the safety latch and exerts a force moving the safety latch to the unlatched position, further extension of the hydraulic cylinder causing the hydraulic cylinder to exert a force on the wedge in a direction substantially opposite to the wedge bias force to move the wedge toward the open position;

the single acting hydraulic cylinder configured such that when pressurized fluid is released from the hydraulic cylinder, the hydraulic cylinder retracts and the wedge moves into the groove in response to the wedge bias force until the wedge reaches the closed position, and then the hydraulic cylinder further retracts and the safety latch moves to the latched position in response to the latch bias force; and a remotely operated control operative to selectively direct pressurized fluid into the hydraulic cylinder and release pressurized fluid from the hydraulic cylinder

6. The apparatus of claim 5 wherein the safety latch comprises a safety pin that engages a pin aperture when in the latched position, wherein the safety pin is pivotally attached at a top end thereof to a pin arm such that movement of the pin arm causes movement of the safety pin into or out of the pin aperture, and wherein an end of the hydraulic cylinder bears against the pin arm.

7. The apparatus of claim 5 comprising a safety switch in an operator's position on the tool manipulating machine and operative, when in a safe position, to prevent activation of the control.

8. The apparatus of claim 5 comprising an indicator operative to indicate to an operator that the safety latch is in the latched position.

* * * * *